US005395151A

United States Patent [19]

Eberle

[11] Patent Number: 5,395,151

[45] Date of Patent: Mar. 7, 1995

[54] GRIPPER FOR A CONVEYING DEVICE FOR CONVEYING SINGLE-SHEET OR MULTI-SHEET PRINTED PRODUCTS

[75] Inventor: Jurg Eberle, Hinwil, Switzerland

[73] Assignee: Ferag AG, Hinwil, Switzerland

[21] Appl. No.: 158,616

[22] Filed: Nov. 29, 1993

[30] Foreign Application Priority Data

Dec. 2, 1992 [CH] Switzerland ..... 03694/92

[51] Int. Cl.[6] ..... B65G 47/86

[52] U.S. Cl. ..... 294/104; 294/99.1; 271/204; 271/277; 198/803.9

[58] Field of Search ..... 294/104, 99.1; 271/204, 271/205, 206, 268, 277; 198/470.1, 803.7, 803.8, 803.9

[56] References Cited

U.S. PATENT DOCUMENTS

| | | | |
|---|---|---|---|
| 4,307,801 | 12/1981 | Hänsch . | |
| 4,381,056 | 4/1983 | Eberle . | |
| 4,638,906 | 1/1987 | Winiasz | 198/803.9 |
| 4,681,213 | 7/1987 | Winiasz | 294/104 X |
| 4,746,007 | 5/1988 | Houseman . | |
| 4,852,722 | 8/1989 | Houseman . | |
| 4,905,818 | 3/1990 | Houseman . | |
| 4,921,294 | 5/1990 | Klopfenstein | 294/104 X |
| 4,953,847 | 9/1990 | Honegger . | |
| 4,968,081 | 11/1990 | Beight et al. . | |
| 4,982,944 | 1/1991 | Eberle | 271/204 |
| 5,064,187 | 11/1991 | Muller . | |
| 5,178,262 | 1/1993 | Merkli et al. | 198/803.9 |
| 5,188,349 | 2/1993 | Honegger . | |

FOREIGN PATENT DOCUMENTS

| | | |
|---|---|---|
| 25830/67 | 8/1967 | Australia . |
| 0287143 | 9/1985 | European Pat. Off. . |
| 0203553 | 5/1986 | European Pat. Off. . |
| 0312755 | 9/1988 | European Pat. Off. . |
| 0330868 | 8/1989 | European Pat. Off. . |
| 2337210 | 7/1973 | Germany . |
| 2043599A | 2/1980 | United Kingdom . |

*Primary Examiner*—Dean J. Kramer

*Attorney, Agent, or Firm*—Willian Brinks Hofer Gilson & Lione

[57] ABSTRACT

A gripper includes two gripper parts. The first gripper part is arranged pivotably relative to the other, second gripper part. The two gripper parts interact to securely hold a printed product at the free ends of the gripper parts. The first gripper part is mounted by a ball joint in a bearing part, which is seated unrotatably on a rotatably mounted hollow shaft. A compression spring is mounted in the first gripper part between the bearing part and the first gripper part, which is spherically mounted in the latter. The compression spring in the closed position of the bearing part exerts a compressive force on the first gripper part. The ball joint is offset rearwards with respect to the pivot axis of the bearing part. As a result, a rearward lengthening of the leg of the first gripper part is attained. This results in more favorable leverages and, with a given compression spring, accordingly results in higher clamping forces at the free end of the first gripper part.

26 Claims, 3 Drawing Sheets

GRIPPER FOR A CONVEYING DEVICE FOR CONVEYING SINGLE-SHEET OR MULTI-SHEET PRINTED PRODUCTS

BACKGROUND OF THE INVENTION

The present invention relates to a gripper for a conveying device for conveying single-sheet or multi-sheet printed products, such as newspapers, periodicals and parts thereof as well as supplements therefor. More particularly, the present invention is directed to a gripper for a conveying device which provides greater clamping forces in comparison with known grippers with a compact design.

Such known grippers are described, for example, in U.S. Pat. No. 4,381,056 and corresponding DE A 31 02 242.

SUMMARY OF THE INVENTION

To achieve these and other objects a gripper is provided for a conveying device for conveying printed products. The gripper includes a first gripper part and a second gripper part, each of which has a free end. The first gripper part is pivotal relative to the second gripper part such that it has a clamping position to securely clamp a printed product. When the first gripper part is in the clamping position, the free end of the first gripper part interacts, under spring action, with the free end of the second gripper part. A bearing part which pivots about a first pivot axis from an open position to a closed position is provided. The first gripper part is mounted pivotably about a second pivot axis, which runs essentially parallel to the first pivot axis. The gripper includes a pivot bearing for the first gripper part which is off-set with respect to the first pivot axis. A locking mechanism which is releasable by an opening arrangement holds the bearing part in its closed position. A transfer element is connected such that it transfers the pivoting movement of the bearing part to the first gripper part and generates a spring-elastic clamping force. The spring-elastic clamping force acts via the free end of the first gripper part when the bearing part is in the closed position.

BRIEF DESCRIPTION OF THE DRAWINGS

Exemplary embodiments of the subject-matter of the invention are explained in more detail below with reference to the drawings.

DETAILED DESCRIPTION OF THE PRESENTLY PREFERRED EMBODIMENTS

Figure 2:
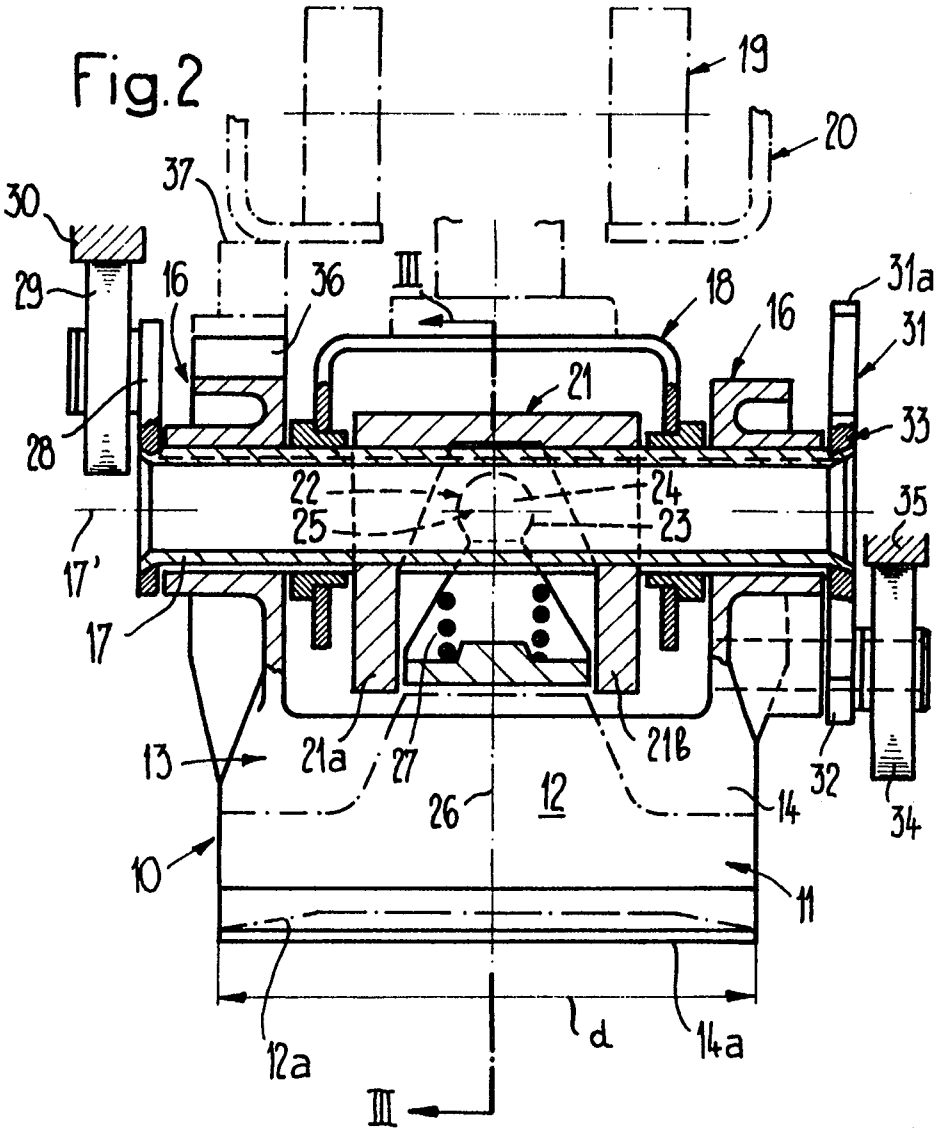
FIG. 2 shows the gripper according to FIG. 1 in front view in the direction of the arrow A in FIG. 1 and partially in section.
Figure 1:
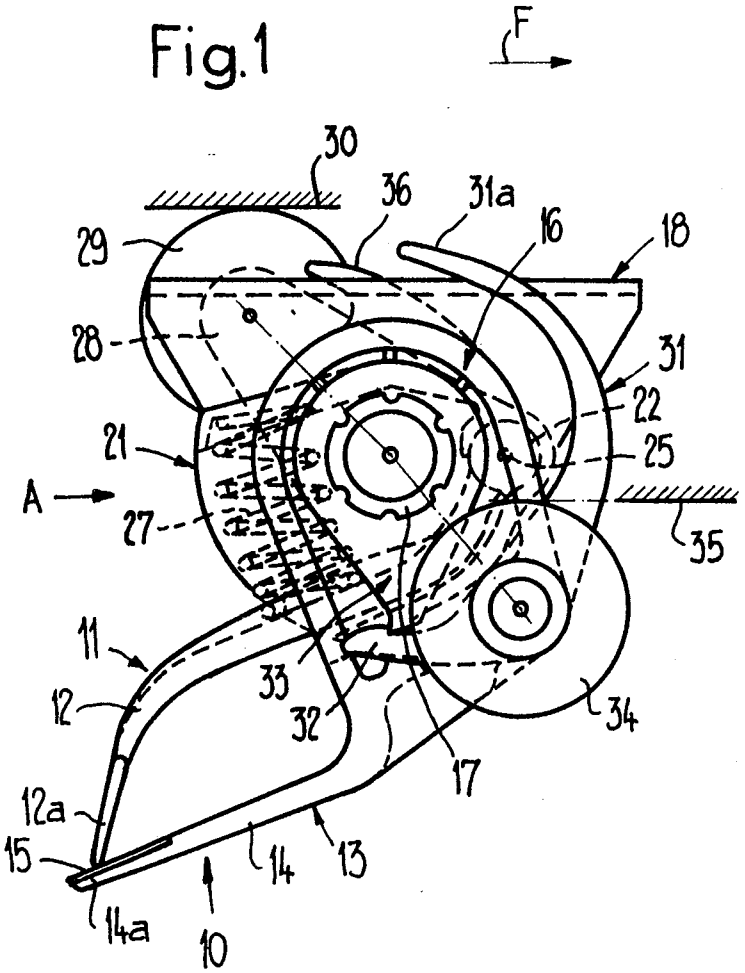
FIG. 1 shows in side view a preferred embodiment of the gripper of the present invention in the closed state.

Referring to the figures, the grippers 10 have a first gripper part 11, the leg of which is denoted by 12, and a second gripper part 13, the leg of which is denoted by 14. In the opened state of the grippers 10, the two gripper parts 11 and 13 define a gripper opening 15. The first gripper part 11 is pivotable, as described in more detail below, with respect to the second gripper part 13 and is shown in FIGS. 1 and 2 in its closed position. The free end 12*a* of the first gripper part 11 interacts with the free end 14*a* of the second gripper part 13 for securely clamping a printed product (not shown in FIGS. 1 and 2).

The second gripper part 13 is preferably designed in one piece with a carrying part 16, which is mounted pivotably on a hollow shaft 17, the longitudinal axis of which is denoted by 17'. The shaft 17 is provided with longitudinal grooves, as can be seen from the figures. The shaft 17 is mounted rotatably in a cross-sectionally U-shaped securing means 18. The U-shaped securing means 18 is fastened on an endless link chain 19, which is guided in a guide channel 20 (see FIG. 2). On this endless link chain 19, which is of a known type, there are fastened at regular intervals a plurality of grippers 10, which define a known conveying device for conveying printed products. Such a conveying device is shown and described, for example, in U.S. Pat. No. 4,953,847 and the corresponding EP-A-0 330 868.

The conveying direction of this conveying device is illustrated in FIG. 1 by an arrow denoted by F. As FIG. 1 shows, the gripper opening 15 points rearwards with respect to this conveying direction F.

A bearing part 21 for the first gripper part 11 is further connected to the shaft 17 in a rotationally fixed manner. The gripper part 11 is mounted pivotably and tiltably in bearing part 21 by means of a ball joint 22 in a manner described below. The ball joint 22 has a socket part 23, which is formed in the bearing part 21. A ball part 24, which is formed at the end of the leg 12 of the first gripper part 11 is held in the socket part 23. The ball joint 22 is designed as a snap connection, i.e. the first gripper part 11 can be pressed by its ball part 24 into the socket part 23 in a simple manner during assembly of the gripper 10. Due to the design of the bearing for the first gripper part 11 as ball joint 22, the first gripper part 11 can, on the one hand, be pivoted about an axis 25, which runs essentially parallel to the longitudinal axis 17' of the hollow shaft 17. Upon a pivoting of the first gripper part 11 about this pivot axis 25, the first gripper part 11 is pivoted away from or towards the second gripper part 13. On the other hand, the spherical mounting of the first gripper part 11 also allows a tilting of the first gripper part 11 about a tilt axis 26, which is defined by the longitudinal axis running from the ball joint 22 to the free end 12*a* of the first gripper part 11, as shown in FIG. 2. This ability to tilt the first gripper part 11 about this tilt axis 26 provides secure holding even of printed products which are of different thicknesses over the width of the gripper 10. In order to prevent undesired and uncontrolled movements of the spherically mounted first gripper part 11, the first gripper part 11 is arranged between two guide walls 21*a*, 21*b* (FIG. 2) formed on the bearing part 21.

As can be readily seen from the figures, the ball joint 22 is offset rearwards, seen from the free end 12*a* of the first gripper part 11, with respect to the longitudinal axis 17′ of the hollow shaft 17 and consequently the pivot axis of the bearing part 21. In other words, the movable gripper part 11 is mounted outside the actual gripper axis (which is formed by the longitudinal axis 17′ of the hollow shaft 17) which also forms the pivot axis for the second gripper part 13 and consequently of the complete gripper 10. Insofar as the advantages of this arrangement are not readily apparent, a further explanation is given below in conjunction with FIG. 5.

Figure 4:
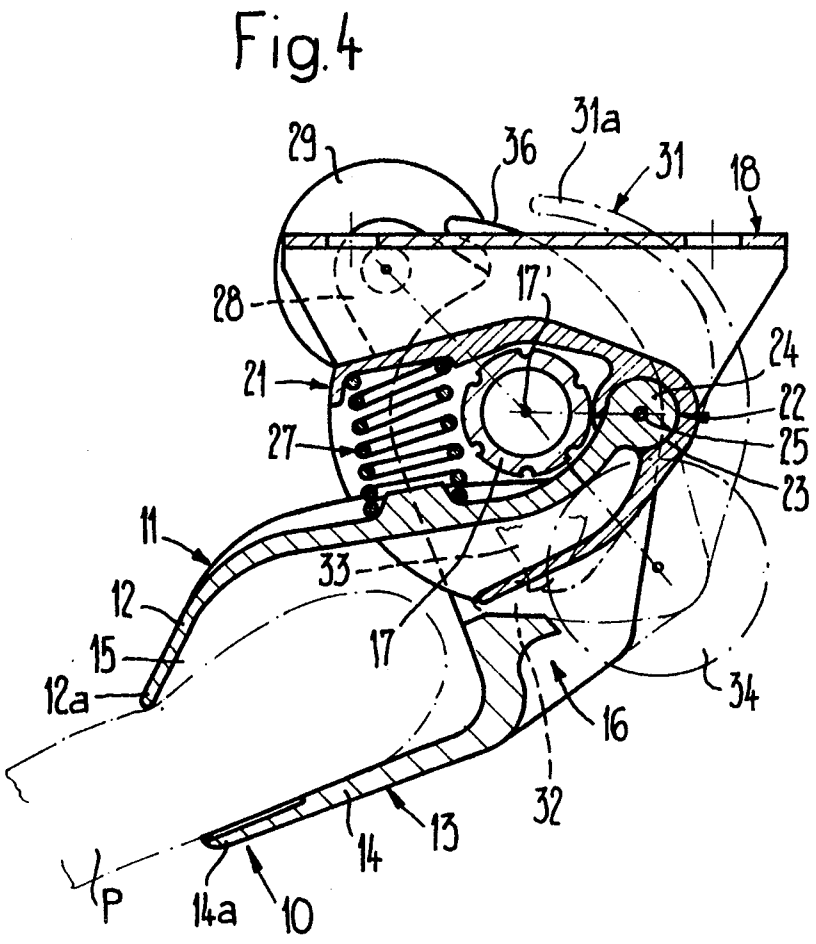
FIG. 4 shows in a representation corresponding to FIG. 3 the gripper at the end of the clamping operation, i.e. in the closed position.
Figure 3:
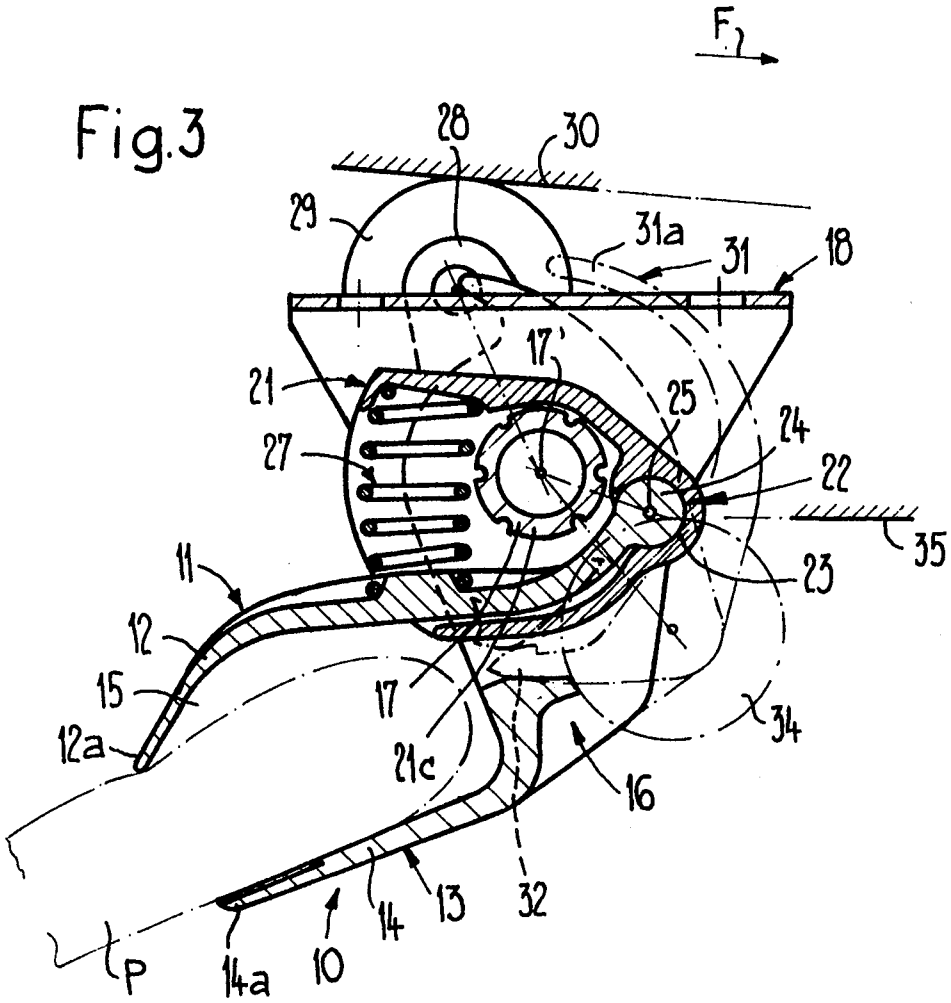
FIG. 3 shows in section along the line III—III in FIG. 2 a gripper at the beginning of clamping a printed product.

On the bearing part 21 for the first gripper part 11 there is supported a compression spring 27. The other end of the compression spring 27 is supported on the leg 12 of the first gripper part 11 and brings this gripper part 11 to bear against the bottom 21*c* of the bearing part 21 (FIG. 3). As can be readily seen from FIGS. 1, 3 and 4, a rotational movement of the shaft 17, and consequently also of the bearing part 21, in the counterclockwise direction is transferred via this compression spring 27 to the first gripper part 11. This pivots the first gripper part 11 out of an open position, shown in the figures, into the clamping position, which is represented in FIG. 4. Thus, the compression spring 27 defines a transfer element.

To the shaft 17 there is connected in a rotationally fixed manner a closing lever 28, the pivot axis of which coincides with the longitudinal axis 17′ of the hollow shaft 17. At its free end, the closing lever 28 bears a follow-up roller 29, which is freely rotatable. In order to pivot the hollow shaft 17 and consequently the bearing part 21, this follow-up roller 29 interacts with fixed-in-place closing links or cams 30, of which one closing link or cam is shown in FIGS. 1, 2 and 3.

A locking mechanism is provided for blocking the bearing part 21 in its closed position. The locking mechanism has a locking lever 31 which is mounted pivotally on the carrying part 16. This locking lever 31 has at its one end a detent 32. The detent 32 interacts with a blocking member 33 to lock the bracing part 21. The blocking member 33 is connected to one end of the hollow shaft 17 in a rotationally fixed manner. This blocking member 33 is fully visible in FIG. 1 and represented partially cut-away in FIG. 2. The locking lever 31 is held in its blocking position by means of a spring (not shown). The end 31*a*, lying opposite the detent 32, of the two-armed locking lever 31 is intended to interact with opening cams links (not shown in the figures) which pivot the locking lever 31 out of the blocking position into a release position. It will be recognized in the art that other suitable locking and/or blocking mechanisms may be used without departing from the spirit of the invention.

A positioning follow-up roller 34 is arranged on the carrying part 16 for the second gripper part 13, on the same side as the locking lever 31. The positioning follow-up roller 34 is mounted in a freely rotatable manner. This positioning follow-up roller 34 interacts with positioning cams or links 35, by which the pivoted position of the second gripper part 13 and consequently of the open and closed gripper 10 is defined. It will be appreciated that the positioning cams or links 35 have to be designed in a way corresponding to the respectively desired pivoted position of the grippers 10.

A control cam 36 is provided on the carrying part 16 for the second gripper part 13, on the side opposite the positioning follow-up roller 34. By the interaction of this control cam 36 with control links (one link 37 is represented in FIG. 2), the carrying part 16 and consequently the second gripper part 13 are pivoted into a position favorable for the interaction of positioning follow-up roller 34 and fixed-in-place positioning cam or link 35. Thus, the grippers 10 can assume any desired pivoted position outside the range of product take-over and surrender. Then, by means of this control cam 36 and the associated link 37, a prepositioning of the gripper 10 takes place before the positioning follow-up roller 34 arrives in the region of the positioning cam or link 35.

The operating principle of a gripper 10 is now explained below with reference to FIGS. 1–4. In the open position (not represented in the figures) of the gripper 10, i.e. with bearing part 21 in the open position, the compression spring 27 is already under tension. Before the closing of the gripper 10, the second gripper part 13, is prepositioned, if appropriate by the control cam 36 and the link 37 interacting with the latter, and then brought by the positioning link 35, acting on the positioning follow-up roller 34, into the desired product-receiving position (represented in FIGS. 3 and 4) and held in this position. In order to pivot the bearing part 21 from the open position into the closed position, the closing link 30 begins to act on the follow-up roller 29 of the closing lever 28, which as a result is pivoted counterclockwise. This results in a corresponding rotation of the hollow shaft 17 and consequently also of the bearing part 21. The rotating position of the bearing part 21 is transferred via the compression spring 27 to the leg 12 of the first gripper part 11, without the compression spring 27 first being further tensioned thereby. As a result, the first gripper part 11 is pivoted in the direction towards the second gripper part 13 and thus towards the clamping position. Once the closing lever 28 has reached its position represented in FIG. 3, the free end 12*a* of the first gripper part 11 comes into contact with the product P which is to be securely clamped, which rests with the underlying side on the leg 14 of the second gripper part 13. In this position, the compression spring 27 already exerts a certain clamping force. As can be seen from FIG. 3, the blocking member 33 now begins to run onto the detent 32 of the locking lever 31. Upon further turning of the closing lever 28, the locking lever 31 is then pushed back out of its blocking position by the blocking member 33, continuing to act on the detent 32, i.e. it is pivoted counterclockwise. Once the closing lever 28 has reached its end position, predetermined by the closing link 30, a locking of the closing lever 28 and of the bearing part 21 in its closed position is performed by the detent 32, acting on the blocking member 33, of the locking lever 31 (FIG. 4). During the pivoting of the closing lever 28 from the position shown in FIG. 3 into the position according to FIG. 4, the compression spring 27 is compressed. This results in a corresponding increase of the clamping force which is exerted by the first gripper part 11. The magnitude of this clamping force depends not only on the force of the compression spring 27 which is acting on the gripper part 11 in the open position of the gripper 10 (pretensioning force), but also on the thickness of the printed product P securely clamped between the gripper parts 11, 13.

Figure 5:
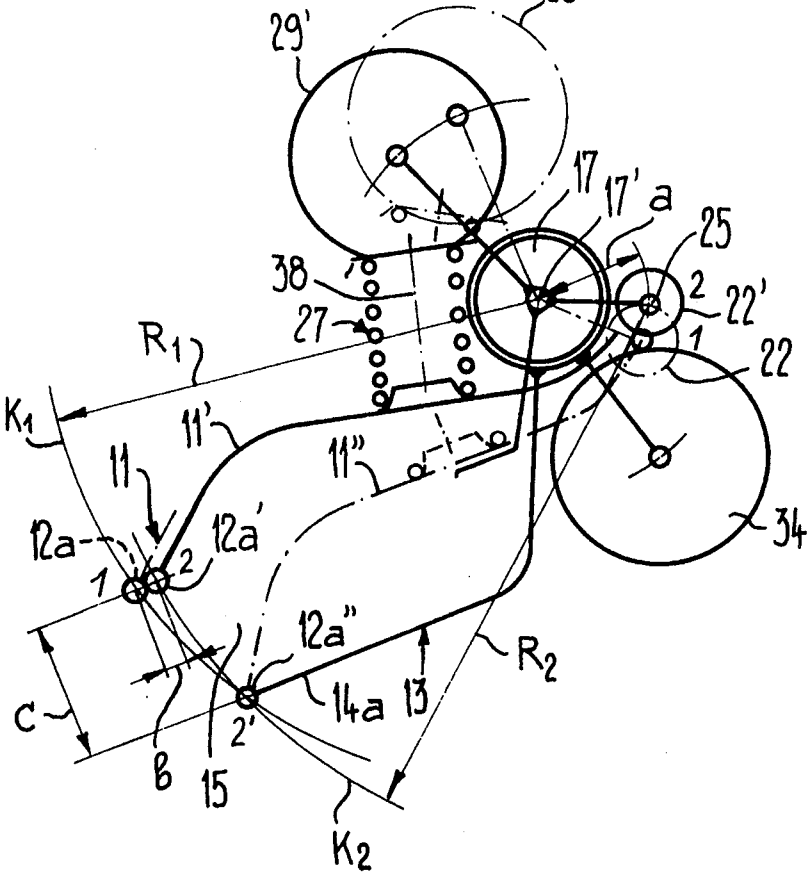
FIG. 5 shows in diagrammatic representation the functional principle of the gripper shown in FIGS. 1 and 2.

The closing operation described above is now explained in even further detail with reference to FIG. 5, in which the individual parts of a gripper 10 are represented only diagrammatically. During the pivoting of the bearing part 21 and consequently also of the first gripper part 11 into the intermediate position shown in FIG. 3, the end 12*a* of the first gripper part 11 moves along a circular arc $K_1$ as far as the position denoted in FIG. 5 by 1. The center of the circular arc $K_1$ lies on the longitudinal axis 17' of the hollow shaft 17 (which is, of course, also the pivot axis of the bearing part 21). The radius of the circular arc $K_1$ is denoted by $R_1$. The first gripper part 11, located in this intermediate position, is indicated by dot-dashed lines, the ball joint 22 assuming the position denoted by 1. Upon further turning of the bearing part 21, which as already explained results in a compressing of the compression spring 27, a relative movement occurs between the bearing part 21 and the first gripper part 11. The ball joint 22' is moved into the position denoted in FIG. 5 by 2, while the free end 12*a*, resting on the printed product P, of the first gripper part 11 is first displaced by the distance b rearwards into the position likewise denoted by 2. By this displacement of the free end 12*a* of the first gripper part 11, a drawing effect is exerted on the printed product P. This drawing effect tends to push the printed product even further into the gripper 10. Subsequently, upon further pivoting of the first gripper part 11, the free end 12*a* of the first gripper part is moved along a circular arc $K_2$, the center of which lies on the pivot axis 25, determined by the ball joint 22', and the radius of which is denoted by $R_2$.

As discussed, the end 12*a* of the first gripper part 11 moves along the circular arc $K_1$ until this end 12*a* meets a printed product. In the case of thin printed products, this means that the gripper part end 12*a* runs along this circular arc $K_1$ until almost up to the point denoted by 2, i.e. almost up to the end 14*a* of the other gripper part 13. The above-mentioned rearward movement of the end 12*a* of the gripper part 11 is accordingly extremely small, or virtually non-existent, in the case of thin products.

In FIG. 5, the useful width of the gripper opening 15 for the gripping of printed products of differing thickness is denoted by c. As can be further seen from FIG. 5, the ball joint 22 or the pivot axis 25 (defined by the ball joint 22) of the first clamping part 11 is offset rearwards. That is, the pivot axis 25 is offset in a direction away from the free end 12*a* of the first gripper part 11, by the distance a with respect to the pivot axis 17' of the bearing part 21. In this way, a lengthening of the leg 12 of the first gripper part 11 in the direction away from the line of application 38 of the compression spring 27 is obtained (FIG. 5). This means that, with a given compression spring 27, greater clamping forces are attained at the free end 12*a* of the first gripper part 11 than in the case where the pivot axis of the first gripper part 11 coincides with the pivot axis 17' of the bearing part 21. Thus, the part of the leg 12 of the first gripper part 11 lying between the line of force application 38 of the compression spring 27 and the free end 12*a* does not have to be lengthened in order to increase these clamping forces. This permits a compact design with gripper legs 12, 14 which are as short as possible.

Separating the one pivot axis 25 for the first gripper part 11 from the other pivot axis 17' for the bearing part 21 permits more freedom in the design of the pivot bearing 22 of the first gripper part 11. Thus, as discussed, this pivot bearing may be designed as ball joint 22, which as explained permits a certain tilting of the first gripper part 11 about its longitudinal axis 26 (see FIG. 2). Consequently, the first gripper part 11 can adapt itself in its position to a printed product P, even if the latter is of differing thickness over its width. This means that in the area of the free end 12*a* of the first gripper part 11 an essentially equally strong clamping of the printed product P takes place over its entire width d (FIG. 2), even if said product is of unequal thickness. This ensures a secure clamping of the printed products.

For opening the grippers 10 and consequently for releasing the seized printing products P, an unlocking force is exerted on the end 31*a* of the locking lever 31 by means of opening cams or links (not shown in the figures). This unlocking force pivots the locking lever 31 counterclockwise. The blocking member 33 can then detach itself from the detent 32. This permits the bearing part 21 and consequently also the hollow shaft 17 to pivot under the action of the then relaxed compression spring 27.

Figure 6:
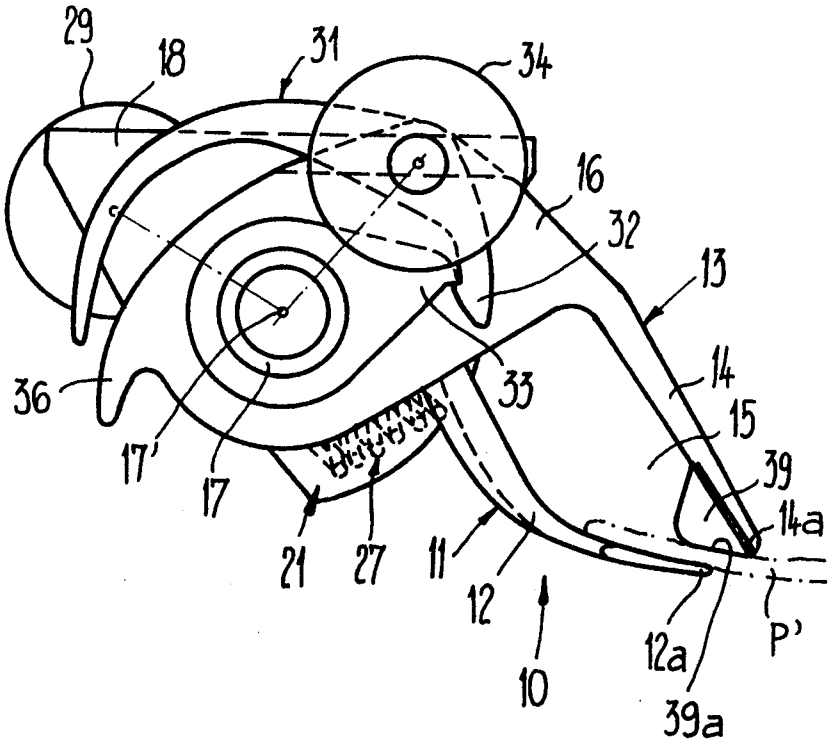
FIG. 6 shows in a representation corresponding to FIG. 1 of a different embodiment of a gripper of the invention in a different pivoted position than that represented in FIG. 1.

FIG. 6 shows a gripper 10, which corresponds in design to the gripper shown in FIGS. 1–4 but is pivoted into a position in which the gripper opening 15 runs ahead, seen in movement direction F of the gripper 10. It is evident from the representations of FIGS. 1 and 6 how large the useful pivoting range is, i.e. in which different positions the gripper 10 can seize or surrender printed products.

It should also be noted with respect to FIG. 6 that, on the second gripper part 13 there is provided in the region of its free end 14*a* a clamping member 39 which faces the other gripper part 11 and serves to securely clamp a printed product P'. The clamping member 39 has a clamping face 39*a* which, with gripper 10 closed, lies opposite the end 12*a* of the gripper part 11 and runs approximately parallel with respect to the latter. The printed product P' is held securely between the clamping face 39*a* of the clamping member 39 and the free end 12*a* of the first gripper part 11 in a certain, defined position.

Some of the different possible variants are now dealt with in more detail. As discussed above, the offsetting of the pivot axis 25 of the first gripper part 11 with respect to the pivot axis 17' of the bearing part 21 creates freedoms in the design of the pivot bearing for this first gripper part 11. Due to the design described of this pivot bearing as a ball joint 22, it is possible for the first gripper part 11 to execute a certain tilting movement about its longitudinal axis 26. The pivot bearing can, however, also be designed differently, in order to make it possible for the first gripper part 11 to carry out not only a pivoting movement about an axis 25 running essentially parallel to the pivot axis 17' of the bearing part 21 but also a tilting movement about the longitudinal axis 26 of the first gripper part 11, which axis runs essentially from the pivot bearing 22 to the free end 12*a* of the first gripper part 11.

In the case of the embodiment shown in the figures, in which a compression spring 27 is arranged between the bearing part 21 and the first gripper part 11, the gripper parts 11 and 13 may be made of plastic. In this case, it is not necessary for the legs 12, 14 of the gripper parts 11, 13 to be flexurally very elastic. It is also possible, however, to design at least the leg 12 of the first gripper part 11 as a bending spring and to arrange on the bearing part 21 an essentially inelastic transfer element instead of the compression spring 27. The inelastic transfer element in this case acts approximately in the direction of the line of force application 38 (FIG. 5) on the leg 12 of the first gripper part 11 and first takes the latter along and then deflects at the end of the closing operation described with reference to FIGS. 3 and 4. This generates the desired clamping force at the free end of the first gripper part 11.

It is understood that a wide range of changes and modifications to the embodiments described above will be apparent to those skilled in the art, and are also contemplated. It is therefore intended that the foregoing detailed description be regarded as illustrative rather than limiting, and that it be understood that it is the following claims, including all equivalents which are intended to define the spirit and scope of this invention.

I claim:

1. A gripper for a conveying device for conveying printed products comprising:

a first gripper part having a free end and a second gripper part having a free end, the first gripper part being pivotable relative to the second gripper part, the first gripper part having a clamping position for securely clamping a printed product, and the first gripper part in the clamping position interacting under spring action on its free end with the free end of the second gripper part;

a bearing part being pivotable about a first pivot axis from an open position to a closed position, the first gripper part being mounted pivotably about a second pivot axis, which runs essentially parallel to the first pivot axis, a pivot bearing for the first gripper part, the pivot bearing being offset with respect to the first pivot axis;

a locking mechanism, releasable by a fixed-in-place opening arrangement, holding the bearing part in its closed position, and a transfer element connected to transfer the pivoting movement of the bearing part to the first gripper part and generate a spring-elastic clamping force, acting via the first gripper part on the free end thereof, when the bearing part is in the closed position.

2. The gripper according to claim 1 wherein the pivot bearing for the first gripper part is disposed at a distance from the pivot axis of the bearing part in a direction away from the free end of said first gripper part.

3. The gripper according to claim 1 wherein the pivot bearing for the first gripper part is configured such that the first gripper part is tiltable about its longitudinal axis, the longitudinal axis running from the pivot bearing to the free end of the first gripper part.

4. The gripper according to claim 1 wherein the pivot bearing comprises a ball joint.

5. The gripper according to claim 4 wherein the ball joint comprises a socket part and a ball part connected as a snap connection.

6. The gripper according to claim 1 wherein the transfer element comprises a spring element arranged between the bearing part and the first gripper part such that the transfer element can be tensioned into the closed position upon pivoting of the bearing part and exerts a clamping force on the first gripper part with bearing part blocked in its closed position.

7. The gripper according to claim 6 wherein the spring element acts between the first pivot axis and the free end of the first gripper part.

8. The gripper according to claim 6 wherein the spring element comprises a compression spring and the bearing part comprises a support for the one end of the compression spring such that the compression spring acts with its other end on the first gripper part.

9. The gripper according to claim 1 wherein the leg of the first gripper part comprises a bending spring and the transfer element is arranged between the bearing part and the first gripper part, and acts on the leg, such that with the bearing part blocked in its closed position, the bearing part tensions said bending spring to generate a clamping force.

10. The gripper according to claim 9 wherein the transfer element acts between the first pivot axis and the free end of the first gripper part.

11. The gripper according to claim 1 wherein the bearing part is connected to a pivotably mounted closing lever, for interacting with fixed-in-place closing links to pivot the bearing part into the closed position.

12. The gripper according to claim 11 comprising a rotatably mounted shaft, to which both the closing lever and the bearing part are connected in a rotationally fixed manner and on which the second gripper part is mounted.

13. The gripper according to claim 12 comprising a positioning follow-up element which is coupled to the second gripper part and interacts with a fixed-in-place positioning link to hold the second gripper part in a certain pivoted position.

14. The gripper according to claim 12 wherein the locking mechanism includes a pivotably mounted locking lever which acts on a blocking part of the shaft to block the bearing part in the closed position and which can be pivoted into a release position by the opening arrangement.

15. The gripper according to claim 1 wherein the second gripper part is mounted pivotably about the first pivot axis.

16. The gripper according to claim 1 wherein the second gripper part comprises a clamping member at its free end, the clamping member facing the first gripper part, between which clamping member and the free end of the first gripper part the printed products can be securely clamped.

17. In a gripper conveying device for gripping and conveying individual printed products, the improvement in a gripper comprising:

a) a mounting shaft;

b) a bearing part mounted on said shaft for pivotal movement about the axis of said shaft;

c) a first gripper part mounted on said bearing part for pivotal movement relative thereto about a bearing axis extending substantially parallel to the axis of said shaft;

d) a second gripper part mounted on said shaft for pivotal movement about the axis of said shaft;

e) said bearing part being pivotable about the axis of said shaft between an open position and a closed position relative to said second gripper part;

f) a releasable locking mechanism for holding said bearing part in its closed position;

g) a transfer element between said bearing part and said first gripper part;

h) movement of said bearing part from said open position to said closed position being effective through said transfer element to urge said first gripper part toward said second gripper part; and i) each of said gripper parts having a free end which, when said bearing part is in its closed position, are effective to grip products of varying thickness between them; and j) a spring element in at least one of said bearing part, said transfer element and said first gripper part for exerting a spring-elastic clamping force on a product between said free ends.

18. The improvement in a gripper of claim 17 further characterized in that:

a) said bearing axis is displaced from said shaft axis in a direction opposite from said free end of said first gripper part.

19. The improvement in a gripper of claim 18 further characterized in that:

a) said first gripper part is mounted on said bearing part for tilting movement approximately about the longitudinal axis of said first gripper part.

20. The improvement in a gripper of claim 18 further characterized by and including:

a) a closing lever rigidly connected to said bearing part for pivoting said bearing part about said mounting shaft axis into said closed position when the closing lever engages a closing cam during travel of the gripper.

21. The improvement in a gripper of claim 20 further characterized in that:

a) said closing lever and said bearing part are rigidly connected to said mounting shaft;

b) said second gripper part being mounted on said mounting shaft for pivotal movement relative to said mounting shaft.

22. The improvement of claim 21 further characterized in that:

a) said locking mechanism includes a locking lever pivotally mounted on said gripper;

b) said locking lever being effective to selectively block said mounting shaft against counter-rotation so as to hold said bearing part in said closed position.

23. The improvement in a gripper of claim 21 further characterized by and including:

a) a gripper securing member for securing the gripper to an endless conveying element in said conveying device;

b) said shaft being mounted on said securing member for pivotal movement relative to said securing member.

24. The improvement in a gripper of claim 20 further characterized by and including:

a) a gripper positioning element mounted on said second gripper part and effective, upon engagement with a positioning arm during travel of said gripper, to hold said gripper in a certain position relative to said mounting shaft axis.

25. The improvement in a gripper of claim 18 further characterized in that:

a) said spring element comprises a coil spring.

26. The improvement in a gripper of claim 25 further characterized in that:

a) said coil spring is in said transfer element.

* * * * *